US010288085B2

(12) United States Patent
Kominami et al.

(10) Patent No.: US 10,288,085 B2
(45) Date of Patent: May 14, 2019

(54) CENTRIFUGAL BLOWER

(71) Applicant: MITSUBISHI HEAVY INDUSTRIES THERMAL SYSTEMS, LTD., Tokyo (JP)

(72) Inventors: Satoshi Kominami, Kiyosu (JP); Atsushi Suzuki, Kiyosu (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 8 days.

(21) Appl. No.: 15/567,441

(22) PCT Filed: Feb. 18, 2016

(86) PCT No.: PCT/JP2016/054683

§ 371 (c)(1),
(2) Date: Oct. 18, 2017

(87) PCT Pub. No.: WO2016/170831

PCT Pub. Date: Oct. 27, 2016

(65) Prior Publication Data

US 2018/0112677 A1 Apr. 26, 2018

(30) Foreign Application Priority Data

Apr. 22, 2015 (JP) ..... 2015-087711

(51) Int. Cl.
*F04D 29/44* (2006.01)
*F04D 29/42* (2006.01)
(Continued)

(52) U.S. Cl.
CPC ..... *F04D 29/441* (2013.01); *F04D 29/4233* (2013.01); *F04D 29/663* (2013.01);
(Continued)

(58) Field of Classification Search
CPC .... F04D 29/44; F04D 29/441; F04D 29/4233; F04D 29/663; F04D 29/403; F05B 2240/12; F05B 2240/14; F05B 2260/96
See application file for complete search history.

(56) References Cited

U.S. PATENT DOCUMENTS 7,883,312 B2 * 2/2011 Eguchi ..... F04D 29/162 415/119
8,105,026 B2 * 1/2012 Eguchi ..... F04D 29/422 415/204
(Continued)

FOREIGN PATENT DOCUMENTS

CN 2535590 Y 2/2003
CN 1573124 A 2/2005
(Continued)

OTHER PUBLICATIONS

Written Opinion of the International Searching Authority and International Search Report (forms PCT/ISA/237 and PCT/ISA/210), dated May 24, 2016, for International Application No. PCT/JP2016/054683, with English translations.

*Primary Examiner* — Hieu T Vo
(74) *Attorney, Agent, or Firm* — Birch, Stewart, Kolasch & Birch LLP

(57) ABSTRACT

A centrifugal blower comprises: an impeller (2) provided with blades (12); a casing (3) that houses the impeller (2), surrounds the impeller (2) on an outer side of the impeller (2) in a radial direction of the impeller (2) to form a spiral flow passage (C1) through which air (AR) can flow, and is provided with a nose section (30) forming a start point (S) of the spiral flow passage (C1) and an end point (E) of the spiral flow passage (C1) where one turn of the spiral flow passage (C1) from the start point (S) terminates; a drive unit (4) that rotates the impeller (2) about the center axis (O) of the impeller (2); and a vane (5) that is provided on the
(Continued)

bottom plate (22) of the casing (3), divides the spiral flow passage (C1) in the radial direction of the impeller (2), and extends along a circumferential direction of the impeller (2). The rear edge (6) of the vane (5) is located upstream from the nose section (30) in a primary flow direction (DI) of the spiral flow passage (C1).

9 Claims, 4 Drawing Sheets

(51) Int. Cl.
*F04D 29/66* (2006.01)
*F04D 29/40* (2006.01)

(52) U.S. Cl.
CPC ..... *F04D 29/403* (2013.01); *F05B 2240/12* (2013.01); *F05B 2240/14* (2013.01); *F05B 2260/96* (2013.01)

(56) References Cited

U.S. PATENT DOCUMENTS

| | | | |
|---|---|---|---|
| 2003/0012649 | A1 | 1/2003 | Sakai et al. |
| 2004/0071549 | A1 | 4/2004 | Kim et al. |
| 2004/0258527 | A1 | 12/2004 | Kaneko et al. |
| 2008/0279681 | A1 | 11/2008 | Eguchi et al. |
| 2010/0226766 | A1 | 9/2010 | Eguchi et al. |
| 2012/0211205 | A1 | 8/2012 | Eguchi et al. |

FOREIGN PATENT DOCUMENTS

| | | | |
|---|---|---|---|
| CN | 101668954 | A | 3/2010 |
| JP | 11-280697 | A | 10/1999 |
| JP | 2003-193998 | A | 7/2003 |
| JP | 2006-275024 | A | 10/2006 |
| JP | 2006-307830 | A | 11/2006 |
| JP | 2008-107036 | A | 5/2008 |
| JP | 2010-229871 | A | 10/2010 |
| JP | 2011-99413 | A | 5/2011 |

* cited by examiner

CENTRIFUGAL BLOWER

TECHNICAL FIELD

The present invention relates to a centrifugal blower.

This application claims priority based on Japanese Patent Application No. 2015-087711 filed on Apr. 22, 2015, of which the contents are incorporated herein by reference.

BACKGROUND ART

Centrifugal blowers are commonly known, in which an impeller is rotated to cause a fluid to flow in a spiral flow passage formed in a casing, which in turn feeds the fluid under centrifugal force.

In such a centrifugal blower, a pressure differential arises between a start point of the spiral flow passage and an end point where one turn of the spiral flow passage from the start point terminates. The start point region and the end point region of the spiral flow passage are adjacent to each other, and a phenomenon arises in which the fluid flows backward from the start point, where the pressure is low, toward the end point, where the pressure is high.

This phenomenon is likely to arise during operation in comparatively low flow rate ranges, and is a factor in the occurrence of stalling, which hampers the performance of the centrifugal blower. There is a further problem in that such backflow forms a vortex, which produces low-frequency sound and thus increases noise.

Here, Patent Document 1 discloses a centrifugal blower in which a backflow suppression partition is provided in a casing. This backflow suppression partition aims to suppress the occurrence of backflow as described above.

CITATION LIST

Patent Documents

Patent Document 1: Japanese Unexamined Patent Application Publication No. 2006-307830A

SUMMARY OF INVENTION

Technical Problems

In the above-described Patent Document 1, a backflow suppression effect can be achieved by providing the backflow suppression partition. However, the backflow suppression partition impedes the flow of the fluid out from the impeller near the end point region of the spiral flow passage, reducing the output flow rate and leading to a drop in the performance of the centrifugal blower.

Accordingly, the present invention provides a centrifugal blower capable of suppressing noise while suppressing a drop in the output flow rate of a fluid.

Solution to Problems

A centrifugal blower according to a first aspect of the present invention includes: an impeller provided with blades; a casing that houses the impeller, surrounds the impeller on an outer side of the impeller in a radial direction of the impeller to form a spiral flow passage through which a fluid can flow, and is provided with a nose section forming a start point of the spiral flow passage and an end point of the spiral flow passage where one turn of the spiral flow passage from the start point terminates; a drive unit that rotates the impeller about a central axis of the impeller; and a vane that is provided on a bottom plate of the casing, divides the spiral flow passage in the radial direction of the impeller, and extends along a circumferential direction of the impeller. A rear edge of the vane is located upstream from the nose section in a primary flow direction of the spiral flow passage.

According to this centrifugal blower, the impeller is rotated by the drive unit, which causes the fluid to flow in the spiral flow passage and increases the pressure of the fluid. At this time, backflow moving from the start point of the spiral flow passage toward the end point of the spiral flow passage in a region near the nose section of the casing can be blocked by the vane. Accordingly, the occurrence of vortices near the nose section can be suppressed, and thus a situation in which low-frequency noise is produced by such vortices can be suppressed as well. Furthermore, because the vane is provided at a distance from the nose section, the flow of fluid between the start point and the end point of the spiral flow passage will not be blocked completely. Accordingly, the flow of fluid flowing out from the impeller will not be blocked by the vane along with the backflow, and thus an output flow rate can be ensured.

In a centrifugal blower according to a second aspect of the present invention, a front edge of the vane according to the above-described first aspect may be arranged at a position downstream in the primary flow direction from a leading end of the nose section by a distance greater than or equal to 3.0 times a diameter of the impeller, and the rear edge of the vane may be arranged at a position downstream in the primary flow direction from the leading end of the nose section by a distance less than or equal to 3.7 times the diameter of the impeller.

By defining the dimensions of the vane in this manner, backflow can be suppressed effectively, and at the same time, the flow of the fluid from the impeller is not blocked completely near the nose section. Thus, a drop in the output flow rate of the fluid can be suppressed even more.

In a centrifugal blower according to a third aspect of the present invention, a height dimension of the vane according to the above-described first or second aspect from the bottom plate in the direction of the central axis may be greater than a height dimension of the blades from the bottom plate in the direction of the central axis at the ends of the blades on the outer sides of the blades in the radial direction.

By making the vane higher than the blades in this manner, a situation in which the fluid flows back from the end point to the start point of the spiral flow passage over the vane can be suppressed.

In a centrifugal blower according to a fourth aspect of the present invention, the edges of the vane according to any one of the above-described first to third aspects may be formed in angular shapes.

Although the fluid may diverge when flowing along the vane, giving the edges of the vane angular shapes makes it possible to fix the position where the fluid diverges at a set position. This makes it possible to ensure that vortices are produced at substantially the same position, which in turn makes it possible to suppress pressure fluctuations near the vane and suppress the occurrence of low-frequency sound. The occurrence of noise can therefore be suppressed even more.

In a centrifugal blower according to a fifth aspect of the present invention, in the vane according to any one of the above-described first to fourth aspects, a recessed part recessed toward the bottom plate and a protruding part protruding in the direction away from the bottom plate may be formed in an end face of the vane facing in the direction of the central axis.

By forming a recessed part and a protruding part in the vane in this manner, a plurality of vortices produced by the fluid flowing along the vane to diverge can be produced by the recessed part and the protruding part. The vortices interfere and collide with one another, which makes the vortices finer. Even if backflow from the end point to the start point of the spiral flow passage arises, the backflow can be disrupted by the fine vortices. Thus, the occurrence of low-frequency sound can be suppressed even more, and the occurrence of noise can be suppressed.

Advantageous Effects of Invention

According to the above-described centrifugal blower, by providing the vane so that a rear edge thereof is distanced from the nose section, the occurrence of noise can be suppressed while suppressing a drop in the output flow rate of the fluid.

DESCRIPTION OF EMBODIMENTS

A centrifugal blower 1 according to a first embodiment of the present invention will be described hereinafter.

The centrifugal blower 1 is a blower device installed, for example, in a vehicle such as an automobile, that can deliver air (a fluid) AR into the cabin of the vehicle.

Figure 1:
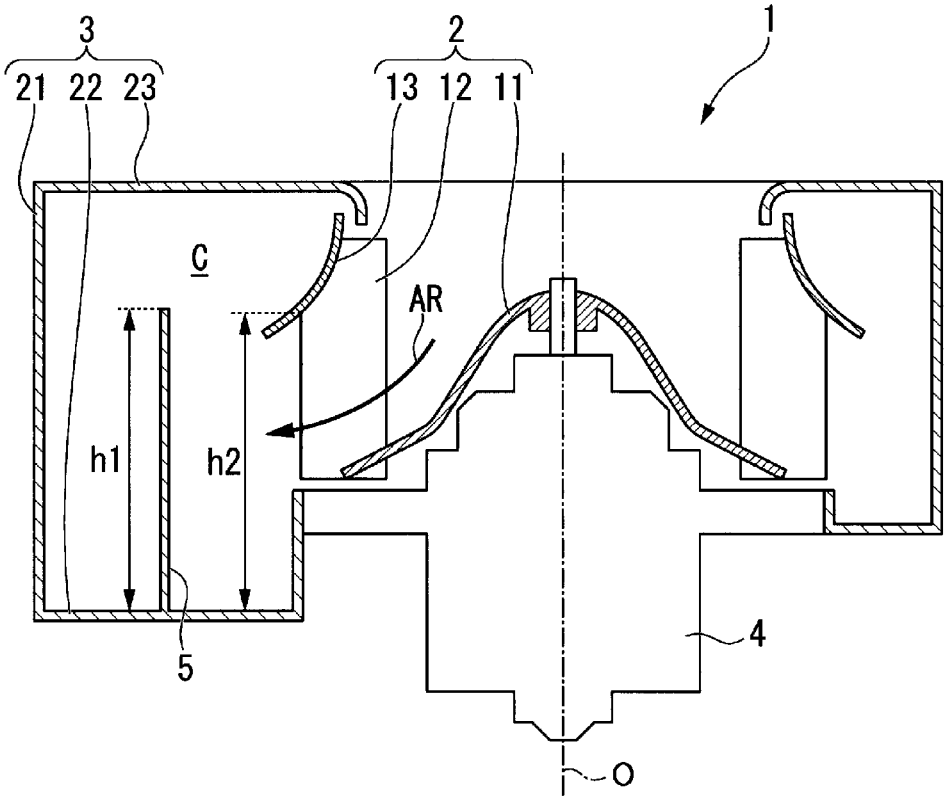
FIG. 1 is a vertical cross-sectional view of a centrifugal blower according to an embodiment of the present invention.

As illustrated in FIG. 1, the centrifugal blower 1 includes an impeller 2, a casing 3 that houses the impeller 2, a drive unit 4 that rotates the impeller 2, and a vane 5 provided within the casing 3.

The impeller 2 includes: a hub 11 shaped as a disk centered on a central axis O; a plurality of blades 12 projecting upward from the hub 11 in the direction of the central axis O and arranged at intervals from each other in a circumferential direction; and a shroud 13 that covers the blades 12 from the direction of the central axis O.

When the impeller 2 rotates about the central axis O, a centrifugal force is imparted on the air AR (the fluid) taken in between adjacent ones of the blades 12 from the shroud 13 side. The air AR is fed from the inner side in the radial direction toward the outer side, and then flows out from the impeller 2 toward the outer side in the radial direction.

The casing 3 includes: a side plate 21 that surrounds the impeller 2 from the outer circumferential side thereof, and opposes end portions of the blades 12 on the outer side thereof in the radial direction; a bottom plate 22 that supports the side plate 21 from the side on which the hub 11 is located with respect to the direction of the central axis O; and a top plate 23 that supports the side plate 21 from the side on which the shroud 13 is located with respect to the direction of the central axis O.

The side plate 21, the bottom plate 22, and the top plate 23 are provided so as to extend along a tangential direction of the hub 11 from a part of those plates in the circumferential direction thereof.

Figure 2:
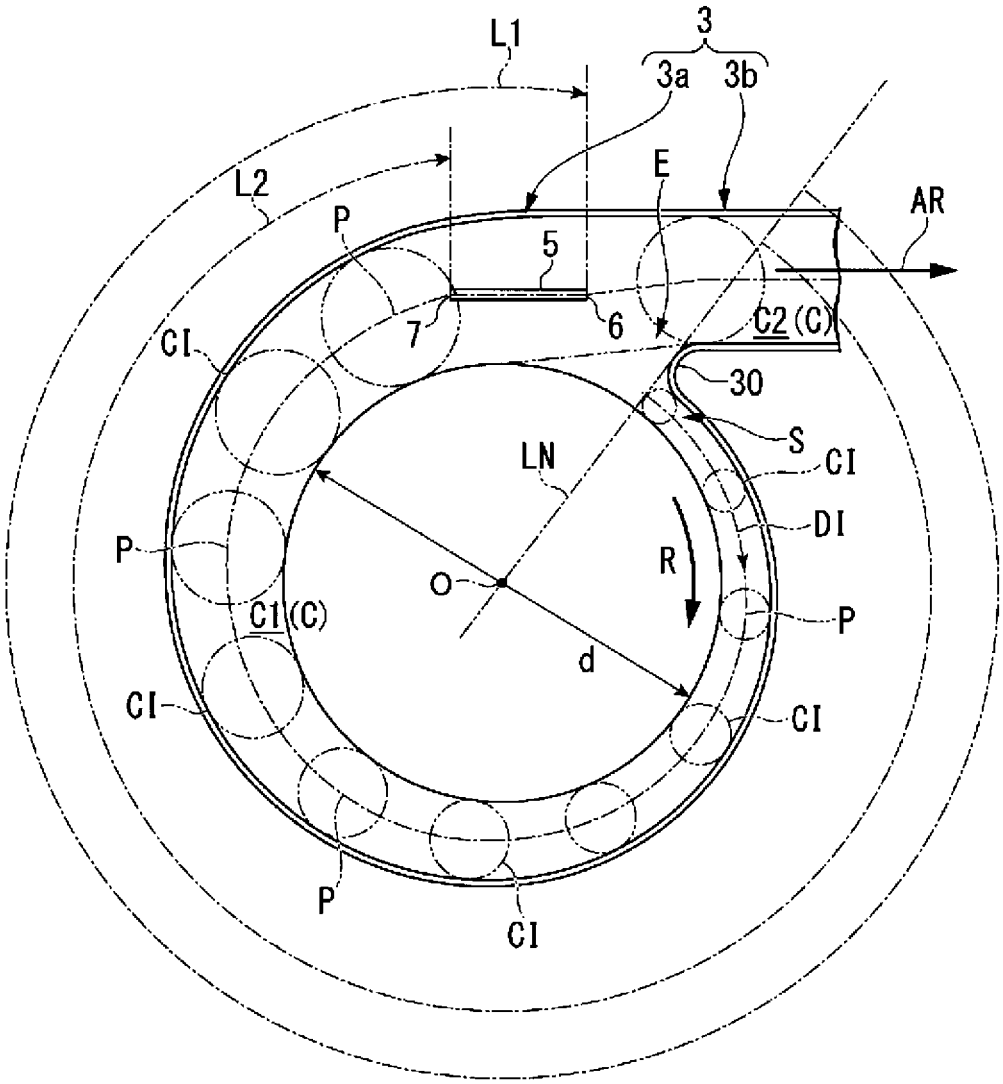
FIG. 2 is a plan view of a casing and an impeller of the centrifugal blower according to the embodiment of the present invention.

In other words, an annular section 3*a* and a linear section 3*b* are formed in the casing 3, as illustrated in FIG. 2. The annular section 3*a* is formed in an annular shape centered on the central axis O, and the linear section 3*b* is formed extending along the above-described tangential direction from a part of the annular section 3*a* in the circumferential direction thereof so as to extend away from the impeller 2. A nose section 30 projecting in the circumferential direction is provided at the area where the annular section 3*a* and the linear section 3*b* connect.

In the casing 3, a space C extending in the circumferential direction is formed on the outer circumferential side of the impeller 2 by being surrounded by the side plate 21, the bottom plate 22, and the top plate 23. The space C serves as a spiral flow passage C1 in the annular section 3*a*, and as an output flow passage C2 in the linear section 3*b*.

The spiral flow passage C1 has a shape in which the width dimension thereof in the radial direction gradually increases from a starting point at the nose section 30 toward one side in the circumferential direction, i.e., forward in a rotational direction R of the impeller 2. In other words, a region on the side of the surface of the nose section 30 facing one side in the circumferential direction corresponds to a region of a start point S of the spiral flow passage C1, whereas a region on the side of the surface of the nose section 30 facing the other side in the circumferential direction corresponds to a region of an end point E of the spiral flow passage C1.

The pressure of the air AR flowing out from the impeller 2 increases as the air AR flows through the spiral flow passage C1 toward the one side in the circumferential direction from the start point S to the end point E.

The output flow passage C2 extends linearly from the end point E of the spiral flow passage C1 in the above-described tangential direction, enabling the spiral flow passage C1 to communicate with the exterior of the casing 3. After flowing through the spiral flow passage C1, the air AR flows into the output flow passage C2. The air AR can exit to the exterior of the casing 3 through the output flow passage C2.

Although not illustrated here, in the case where the centrifugal blower 1 is used as a blower device in a vehicle, the output flow passage C2 is connected to air flow passages of a vehicular air conditioner. These air flow passages include a dashboard passage, a floor passage, and a defroster passage. A vehicular air conditioner is provided with a cooling heat exchanger and a heating heat exchanger. In a vehicular air conditioner, when in a cooling mode, operating a damper takes the air AR from the output flow passage C2 into the above-described air flow passages after the air AR has first passed the cooling heat exchanger. When in a heating mode, operating the damper takes the air AR from the output flow passage C2 into the above-described air flow passages after the air AR has first passed the cooling heat exchanger and then furthermore passed the heating heat exchanger.

The drive unit 4 is an electric motor or the like. As illustrated in FIG. 1, the drive unit 4 is provided facing the hub 11 of the impeller 2 in the direction of the central axis O, and is fixed to the casing 3. The drive unit 4 supports the impeller 2 on the casing 3 such that the impeller 2 can rotate about the central axis O.

The vane 5 is provided on the end point E side of the spiral flow passage C1 (near the output flow passage C2), projecting from the bottom plate 22 of the casing 3 toward the top plate 23 in the direction of the central axis O (see FIG. 1) and extending along the circumferential direction. The vane 5 therefore divides the spiral flow passage C1 in the radial direction.

Figure 3:
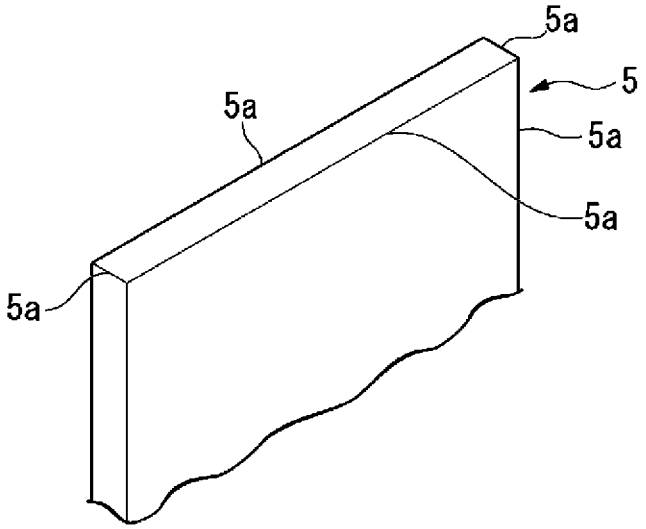
FIG. 3 is a perspective view of a vane of the centrifugal blower according to the embodiment of the present invention.

To be more specific, as illustrated in FIG. 3, the vane 5 has a rectangular planar shape, with all edges 5*a* thereof formed in angular shapes. In other words, no round chamfering or the like is carried out on the edges 5*a*.

Additionally, as illustrated in FIG. 1, a height dimension h1 of the vane 5 from the bottom plate 22 in the direction of the central axis O is greater than a height dimension h2 of the blades 12 from the bottom plate 22 in the direction of the central axis O, at the ends of the blades 12 on the outer sides thereof in the radial direction.

A rear edge 6 of the vane 5, which is an end corresponding to another end of the vane 5 in the circumferential direction (that is, a rear side in the rotational direction R) and that is distanced from the output flow passage C2, is located upstream from the nose section 30 with respect to a primary flow direction DI of the spiral flow passage C1.

"Primary flow direction DI" refers to an extension direction of line segments connecting centers P of inscribing circles CI that inscribe maximum diameter parts of the spiral flow passage C1 between the side plate 21 and the impeller 2, in a plane orthogonal to the central axis O.

Here, it is preferable that the vane 5 be arranged at a position, starting from a straight line LN passing through the central axis O and connecting with the inner surface of the nose section 30 on the space C side thereof, downstream toward the one end of the circumferential direction in the primary flow direction DI of the air AR by greater than or equal to 3.0 times and less than or equal to 3.7 times a diameter d of the impeller 2. "Diameter d of the impeller 2" refers to the diameter of a part of the impeller 2 where the diameter thereof is greatest (in the present embodiment, the end of the shroud 13 on the outer side in the radial direction).

In other words, it is preferable that the rear edge 6 of the vane 5 be arranged at a position that, starting from the above-described straight line LN corresponding to a leading end of the nose section 30, is a distance L1 of less than or equal to 3.7 times the diameter d of the impeller 2 downstream in the primary flow direction DI. It is also preferable that a front edge 7, which is an end of the vane 5, on the one end side in the circumferential direction, that is near the output flow passage C2, be arranged in a position at a distance L2 of greater than or equal to 3.0 times the diameter d of the impeller 2 downstream in the primary flow direction DI from the leading end of the nose section 30.

Furthermore, it is preferable that the vane 5 be arranged at a position greater than or equal to 20% and less than or equal to 50% of the width direction (radial direction) of the spiral flow passage C1 from the part of the impeller 2 where the diameter thereof is greatest.

According to the centrifugal blower 1 of the present embodiment described thus far, when the drive unit 4 causes the impeller 2 to rotate about the central axis O, the air AR flows through the spiral flow passage C1 and the pressure of the air AR rises. In the event where backflow Rf from the start point S toward the end point E of the spiral flow passage C1 arises near the nose section 30 of the casing 3 (see FIG. 4) at this time, the backflow Rf can be blocked by the vane 5.

Accordingly, the occurrence of vortices near the nose section 30 can be suppressed, and thus a situation in which low-frequency noise is produced by such vortices can be suppressed as well. Furthermore, the vane 5 is provided such that the rear edge 6 is located at a distance from the nose section 30 in the primary flow direction DI, and thus the flow of the air AR between the start point S and the end point E of the spiral flow passage C1 will not be completely blocked.

Thus, a flow f1 moving from the impeller 2 near the end point E in the spiral flow passage C1, through the spiral flow passage C1, and toward the output flow passage C2 (see FIG. 4) will not be blocked along with the backflow Rf, making it possible to ensure an output flow rate of the air AR from the centrifugal blower 1.

Figure 4:
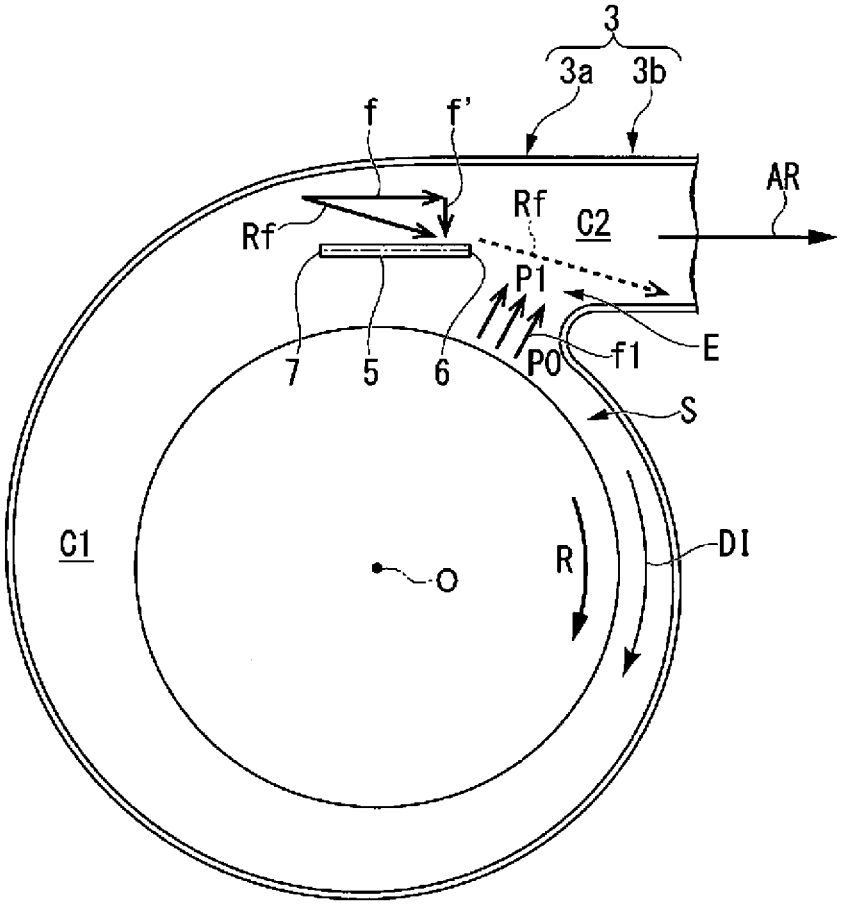
FIG. 4 is a plan view illustrating the casing of the centrifugal blower and directions in which air flows within the casing, according to the embodiment of the present invention.

Specifically, as illustrated in FIG. 4, a component f' of a flow moving inward in the radial direction, produced by a pressure differential between a pressure P0 in the region of the start point S and a pressure P1 in the region of the end point E, is added to a primary flow f of the air AR in the region of the end point E of the spiral flow passage C1. A flow that flows at an angle toward the vane 5 rather than straight toward the output flow passage C2 is formed as a result. This flow is the backflow Rf.

The rear edge 6 of the vane 5 is arranged at a position distanced from the nose section 30 in the primary flow direction DI, but further downstream from the rear edge 6 of the vane 5, the backflow Rf flows downstream from the nose section 30, or in other words, toward the side plate 21 in the output flow passage C2. The backflow Rf is therefore guided into the output flow passage C2 without moving toward the region of the start point S of the spiral flow passage C1 (see the dashed line in FIG. 4).

Accordingly, the vane 5 blocks the backflow Rf across a minimum required range, and at the same time, the flow f1 of the air AR flowing out from the impeller 2 can flow through the spiral flow passage C1 toward the output flow passage C2 from between the rear edge 6 and the nose section 30, making it possible to ensure the output flow rate of the air AR from the centrifugal blower 1. As a result, the occurrence of the backflow Rf can be suppressed while also suppressing a drop in the output flow rate.

The effect of suppressing the backflow Rf and the effect of suppressing a drop in the output flow rate of the air AR can be further improved by setting the range where the vane 5 is provided to greater than or equal to 3.0 times and less than or equal to 3.7 times the diameter d of the impeller 2 from the leading end of the nose section 30 in the primary flow direction DI.

Additionally, the effect of suppressing a situation in which the backflow Rf produces vortices can be enhanced by providing the vane 5 in a position greater than or equal to 20% and less than or equal to 50% of the width direction of the spiral flow passage C1 from the part of the impeller 2 where the diameter is greatest, or in other words, in a position relatively close to the impeller 2.

Additionally, although the air AR may diverge when flowing along the vane 5, giving the edges 5*a* of the vane 5 angular shapes makes it possible to fix the position where the air AR diverges at a set position. This makes it possible to ensure that vortices are produced at substantially the same position, which in turn makes it possible to suppress pressure fluctuations near the vane 5 and suppress the occurrence of low-frequency sound. The occurrence of noise can therefore be suppressed even more.

Furthermore, setting the height dimension h1 of the vane 5 to be greater than the height dimension h2 of the end of the blades 12 makes it possible to suppress backflow in which the backflow Rf flows toward the top plate 23 in the direction of the central axis O and over the vane 5. In other words, the backflow Rf can be blocked effectively.

While the above has described embodiments of the present invention in detail with reference to the drawings, each configuration of each embodiment and the combinations thereof are merely examples, and additions, omissions, substitutions, and other changes may be made without deviating from the spirit and scope of the present invention. The present invention is not to be considered as being limited by the foregoing description but is only limited by the scope of the appended claims.

Figure 5:
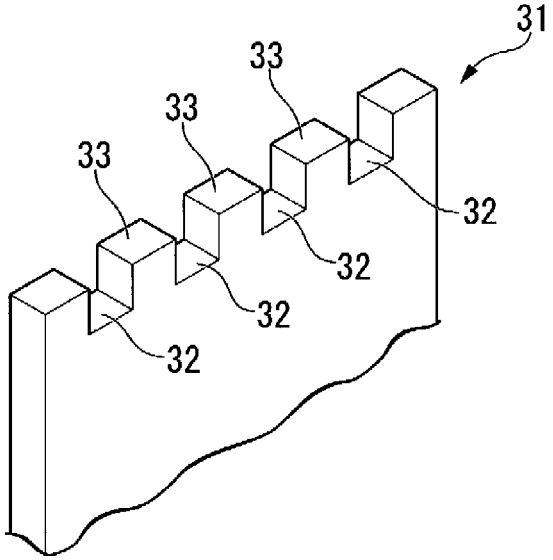
FIG. 5 is a perspective view of a vane of a centrifugal blower according to a first variation on the embodiment of the present invention.

For example, in a vane 31 according to the present embodiment, recessed parts 32 that are recessed toward the bottom plate 22, and protruding parts 33 protruding in the direction of the central axis O toward the top plate 23 and away from the bottom plate 22, may be formed alternately in the primary flow direction DI, in an end face of the vane 31 facing in the direction of the central axis O and opposing the top plate 23, as illustrated in FIG. 5.

When the recessed parts 32 and the protruding parts 33 are formed in the vane 31 in this manner, a plurality of vortices produced by the air AR flowing along the vane 31 to diverge can be produced by the recessed parts 32 and the protruding parts 33. The plurality of vortices interfere and collide with one another, which makes the vortices finer. The occurrence of low-frequency sound can be further suppressed, which leads to increased noise suppression.

Figure 6:
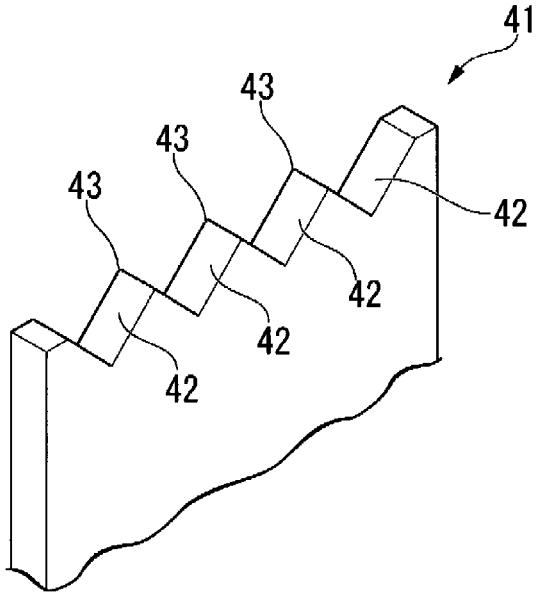
FIG. 6 is a perspective view of a vane of a centrifugal blower according to a second variation on the embodiment of the present invention.

Furthermore, in a vane 41 according to the present embodiment, protruding parts 43 may be formed in triangular shapes such that leading end portions on the top plate 23 side when the vane 41 is viewed along the central axis O serve as apexes, as illustrated in FIG. 6. Likewise, recessed parts 42 may be formed in triangular shapes such that bottom portions on the bottom plate 22 side when the vane 41 is viewed along the central axis O serve as apexes.

The shape of the vane 5 (31, 41) is not limited to the shapes described above, and may be any shape as long as the rear edge 6 is located upstream from the nose section 30 in the primary flow direction DI. In other words, the vane 5 need not have a rectangular planar shape, and may instead have a block shape, for example.

Furthermore, in the vane 5 (31, 41), it is not absolutely necessary for all of the edges 5*a* to be formed in angular shapes.

INDUSTRIAL APPLICABILITY

According to the above-described centrifugal blower, the occurrence of noise can be suppressed while suppressing a drop in the output flow rate of a fluid.

REFERENCE SIGNS LIST

1 Centrifugal blower
2 Impeller
3 Casing
3*a* Annular section
3*b* Linear section
4 Drive unit
5, 31, 41 Vane
6 Rear edge
7 Front edge
11 Hub
12 Blade
13 Shroud
21 Side plate
22 Bottom plate
23 Top plate
30 Nose section
32, 42 Recessed part
33, 43 Protruding part
O Central axis
AR Air (fluid)
C Space
S Start point
E End point
C1 Spiral flow passage
C2 Output flow passage
R Rotational direction
DI Primary flow direction
f Primary flow
Rf Backflow
f1 Flow

The invention claimed is:

1. A centrifugal blower comprising:

an impeller provided with blades;

a casing that houses the impeller, surrounds the impeller on an outer side of the impeller in a radial direction of the impeller to form a spiral flow passage through which a fluid can flow, and is provided with a nose section forming a start point of the spiral flow passage and an end point of the spiral flow passage where one turn of the spiral flow passage from the start point terminates;

a drive unit that rotates the impeller about a central axis of the impeller; and a vane that is provided on a bottom plate of the casing, divides the spiral flow passage in the radial direction of the impeller, and extends along a circumferential direction of the impeller, a rear edge of the vane being located upstream from the nose section in a primary flow direction of the spiral flow passage; and a front edge of the vane being arranged at a position downstream in the primary flow direction from a leading end of the nose section by a distance greater than or equal to 3.0 times a diameter of the impeller, and the rear edge of the vane being arranged at a position downstream in the primary flow direction from the leading end of the nose section by a distance less than or equal to 3.7 times the diameter of the impeller.

2. The centrifugal blower according to claim 1, wherein a height dimension of the vane from the bottom plate in the direction of the central axis is greater than a height dimension of the blades from the bottom plate in the direction of the central axis at the ends of the blades on the outer sides of the blades in the radial direction.

3. The centrifugal blower according to claim 2, wherein the edges of the vane are formed in angular shapes.

4. The centrifugal blower according claim 3, wherein in the vane, a recessed part recessed toward the bottom plate and a protruding part protruding in the direction away from the bottom plate are formed in an end face of the vane facing in the direction of the central axis.

5. The centrifugal blower according claim 2, wherein in the vane, a recessed part recessed toward the bottom plate and a protruding part protruding in the direction away from the bottom plate are formed in an end face of the vane facing in the direction of the central axis.

6. The centrifugal blower according to claim 1, wherein the edges of the vane are formed in angular shapes.

7. The centrifugal blower according claim 6, wherein in the vane, a recessed part recessed toward the bottom plate and a protruding part protruding in the direction away from the bottom plate are formed in an end face of the vane facing in the direction of the central axis.

8. The centrifugal blower according claim 1, wherein in the vane, a recessed part recessed toward the bottom plate and a protruding part protruding in the direction away from the bottom plate are formed in an end face of the vane facing in the direction of the central axis.

9. A centrifugal blower comprising:

an impeller provided with blades;

a casing that houses the impeller, surrounds the impeller on an outer side of the impeller in a radial direction of the impeller to form a spiral flow passage through which a fluid can flow, and is provided with a nose section forming a start point of the spiral flow passage and an end point of the spiral flow passage where one turn of the spiral flow passage from the start point terminates;

a drive unit that rotates the impeller about a central axis of the impeller; and a vane that is provided on a bottom plate of the casing, divides the spiral flow passage in the radial direction of the impeller, and extends along a circumferential direction of the impeller, a rear edge of the vane being located upstream from the nose section in a primary flow direction of the spiral flow passage; and the vane being provided at a position greater than or equal to 20% and less than or equal to 50% of a width direction of the spiral flow passage from a part of the impeller where the diameter of the impeller is greatest.

* * * * *